United States Patent [19]

Wolf et al.

[11] 4,003,158

[45] Jan. 18, 1977

[54] FIGHTING DOLL

[75] Inventors: Tobin Wolf, Passaic, N.J.; Tit Shing Wong, Kowloon, Hong Kong

[73] Assignee: Mego Corporation, New York, N.Y.

[22] Filed: Aug. 1, 1975

[21] Appl. No.: 601,090

Related U.S. Application Data

[63] Continuation-in-part of Ser. No. 502,436, Sept. 3, 1974, abandoned.

[52] U.S. Cl. ..... 46/120

[51] Int. Cl.[2] ..... A63H 11/00

[58] Field of Search ..... 46/142, 148, 119, 120, 46/121, 136; 272/76

[56] References Cited

UNITED STATES PATENTS

| | | | |
|---|---|---|---|
| 525,716 | 9/1894 | McElroy | 46/119 |
| 3,648,405 | 3/1972 | Tepper | 46/120 |
| 3,672,097 | 6/1972 | Gardel et al. | 46/120 |
| 3,758,982 | 9/1973 | Lemelson et al. | 46/148 |
| 3,786,596 | 1/1974 | Breslow et al. | 46/118 |
| 3,858,353 | 1/1975 | Glass et al. | 46/120 |

FOREIGN PATENTS OR APPLICATIONS

| | | | |
|---|---|---|---|
| 672,206 | 10/1964 | Italy | 46/120 |

*Primary Examiner*—Louis G. Mancene
*Assistant Examiner*—Jack Q. Lever
*Attorney, Agent, or Firm*—Kirschstein, Kirschstein, Ottinger & Frank

[57] ABSTRACT

A fighting doll has a lower torso and an upper torso having freely movable arms rotatably mounted thereto. Actuating means within the doll when actuated causes the upper torso to pivot relative to the lower torso and simultaneously swings one arm upward and the other arm downward from a resting position in a fighting motion.

In one embodiment, the actuating means is activated by a push button extending from the lower torso. The upper torso is pivotably secured to the lower torso and to a central shaft which is fixedly mounted to the lower torso. A stationary cup gear is positioned on the central shaft and is in communication with arm pinions secured to shafts extending from each arm. The push button has a rack formed at its end which is in communication with a pinion rotatable on the central shaft. Fixed to the pinion is a sleeve which is secured to the upper torso. By depressing the push button, the pinion and sleeve rotate on the central shaft causing the upper torso to pivot. As the upper torso pivots, the arm pinions move on the stationary cup gear resulting in the arms moving in a fighting motion. Biasing means returns the upper torso and the arms to a rest position when the push button is released.

13 Claims, 8 Drawing Figures

FIGHTING DOLL

CROSS REFERENCE TO RELATED APPLICATIONS

This application is a continuation in part application of copending application, Ser. No. 502,436 for A FIGHTING DOLL filed Sept. 3, 1974, now abandoned.

BACKGROUND OF THE INVENTION

1. Field of the Invention

The present invention relates to a doll and more particularly to a doll in which an actuating mechanism moves the body and arms.

2. Description of the Prior Art

It is well known in the prior art to provide a doll which has a freely movable body and limbs. It is also well known in the art to provide a mechanism which will transmit the movement of one of the doll's limbs to the doll's body and to the other limbs.

Heretofore many of the dolls were expensive to manufacture and included complicated actuating mechanisms. In addition, because of the type of mechanisms employed the dolls were relatively large. It is toward the elimination of these problems that the present invention is directed.

SUMMARY OF THE INVENTION

1. Purposes of the Invention

It is an object of the present invention to provide an extremely realistic fighting or punching doll.

Another object of the present invention is to provide a fighting doll which has a simple and compact actuating mechanism.

Still another object of the present invention is to provide a fighting doll in which the arms may be made to swing as the doll swivels at the waist in a manner simulating realistic fighting motions.

Yet another object of the present invention is to provide a fighting doll in which one of the arms may be easily disengaged, so that the other arm will swing in a manner simulating realistic karate motions.

A further object of the present invention is to provide a fighting doll in which the starting position of the arms may be easily changed.

Still a further object of the present invention is to provide a mechanism which will prevent the arms from being damaged if there is excessive resistance to their movement.

Other objects of the invention in part will be obvious and in part will be apparent in the following description.

2. Brief Description of the Invention

Generally, the foregoing and other objects are achieved by providing a fighting doll which has a lower torso and an upper torso having freely moveable arms rotatably mounted thereto. An actuating means within the upper and lower torso permits the upper torso to swivel and simultaneously raises and lowers the arms simulating a fighting motion.

In one embodiment the upper torso is pivotably secured to the lower torso and to a central shaft which is fixedly mounted to the lower torso. Positioned on the shaft is a cup gear which communicates with arm pinions mounted to shafts extending from each of the arms. A push button protruding from the lower torso has integrally formed therewith a rack which is in operable communication with a pinion on the central shaft. Fixed to the pinion is a sleeve which is free to rotate on the central shaft and which is secured to the upper torso. By depressing the push button, the pinion and sleeve rotate on the central shaft causing the upper torso to pivot relative to the lower torso. The pivoting movement causes the arm pinions to move on the cup gear resulting in the arms swinging in a fighting motion. Biasing means returns the upper torso and the arms to a rest position, when the push button is no longer depressed.

In an alternative embodiment, the upper torso is pivotably mounted to the lower torso. A central shaft fixedly connected to the lower torso supports a stationary cup gear within the upper torso which is in communication through gears with arm pinions mounted to shafts extending from each arm. A lever extending from the lower torso has integrally formed therewith a sleeve which is rotatably mounted on the central shaft. Formed in the end of the sleeve is a plate which is secured to the upper torso. When the lever is moved, the sleeve rotates on the central shaft causing the upper torso to pivot relative to the lower torso. Simultaneously, the gears will move on the stationary cup gear causing the arm pinions to move resulting in the arms swinging in a fighting motion.

Disengagement means in communication with the actuating means permits one of the arms in either of the above embodiments to be disengaged from the cup gear. A slip clutch means in communication with the arms allows the rest position of the arms to be changed and prevents damage to the arms and activating means if excessive resistance to the arm's movement is encountered.

The invention accordingly consists in the features of construction, combinations of elements and arrangements of parts which will be exemplified in the fighting doll hereinafter described and of which the scope of application will be indicated in the appended claims.

BRIEF DESCRIPTION OF THE DRAWINGS

For a better understanding of the present invention, reference should be had to the accompanying drawings, wherein like numerals of reference indicate similar parts throughout the several views and wherein.

DESCRIPTION OF THE PREFERRED EMBODIMENT

Figure 1:
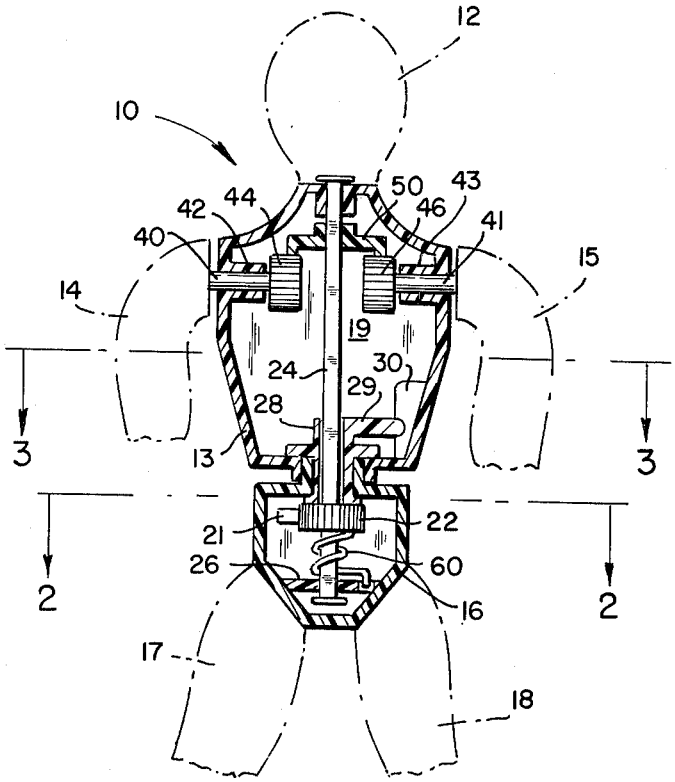
FIG. 1 is a cross-sectional view of the body of a fighting doll constructed in accordance with one embodiment of the present invention, wherein the appendages are shown in phantom lines.

A fighting doll in accordance with the present invention is depicted in FIG. 1, being generally identified by the reference numeral 10. The fighting doll 10 has a head 12 fixed to an upper torso 13. A first arm 14 and a second arm 15 are mounted to the upper torso, so that they are free to swing, in a manner which will be described hereinafter in detail. The upper torso 13 is pivotably mounted to the lower toso 16. The legs 17 and 18 depend from the lower torso 16, and may be integrally formed therewith.

Figure 2:
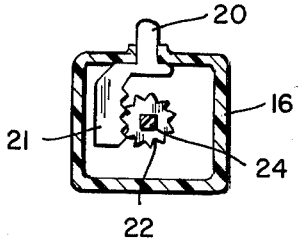
FIG. 2 is a sectional view taken substantially along the line 2—2 of FIG. 1.

In order to move the upper torso 13 and the arms 14 and 15 in a manner simulating realistic fighting motions an actuating means identified generally by reference numeral 19 is located within the body of the fighting doll 10 defined by the upper torso 13 and the lower torso 16, as shown in FIG. 1. A central shaft 24 is shown as having a square cross-section, but it is to be understood that it may have any cross-section that is compatible with the desired movement of the elements of the actuating means. The upper torso 13 is pivotably secured to the opposite end of the central shaft 24. In this manner, the upper torso 13 is kept in operable communication with the lower torso 16. Rotatably mounted on the central shaft 24 within the lower torso 16 is a first pinion 22. As shown in FIG. 2, a push button 20 extends from the lower torso 16 and has a rack 21 integrally formed at its end, which is in operable communication with the first pinion 22.

Figure 3:
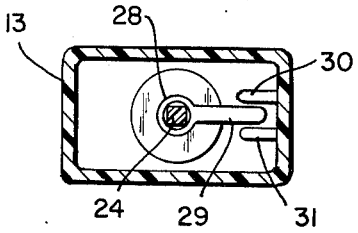
FIG. 3 is a sectional view taken substantially along the line 3—3 of FIG. 1.

Fixed to the first pinion 22 is a sleeve 28 which is also free to rotate on the central shaft 24. Sleeve 28 is provided with a projection 29 which is positioned between ribs 30 and 31 on the inside of the upper torso 13 as shown in FIG. 3. By depressing push button 20, the first pinion 22 and the sleeve 28 will rotate on the central shaft 24 thus causing the upper torso 13 to pivot relative the lower torso 16.

As hereinabove mentioned the first and second arms 14 and 15 respectively are mounted to the upper torso 13 in such a manner that they may rotate or swing thereon. Extending from the upper end of the first arm 14 is a first shaft 40 which has a first arm pinion 44 mounted at its end. The first shaft 40 is journaled within the support 42 and is free to rotate therein. Similarly second arm 15 has a second shaft 41 extending from its upper end with a second arm pinion 46 mounted thereto. The shaft 41 is journaled within support 43 and is free to rotate therein. Fixedly secured to the central shaft 24 is a stationary cup gear 50 which is in operable communication with the arm pinions 44 and 46. Since the cup gear cannot rotate on the shaft 24 when the push button 20 is depressed, as the upper torso 13 rotates, the stationary cup gear 50 will move the first and second arm pinions 44 and 46 thus causing the first and second arms 14 and 15 to swing upward and downward in a fighting motion.

Figure 4:
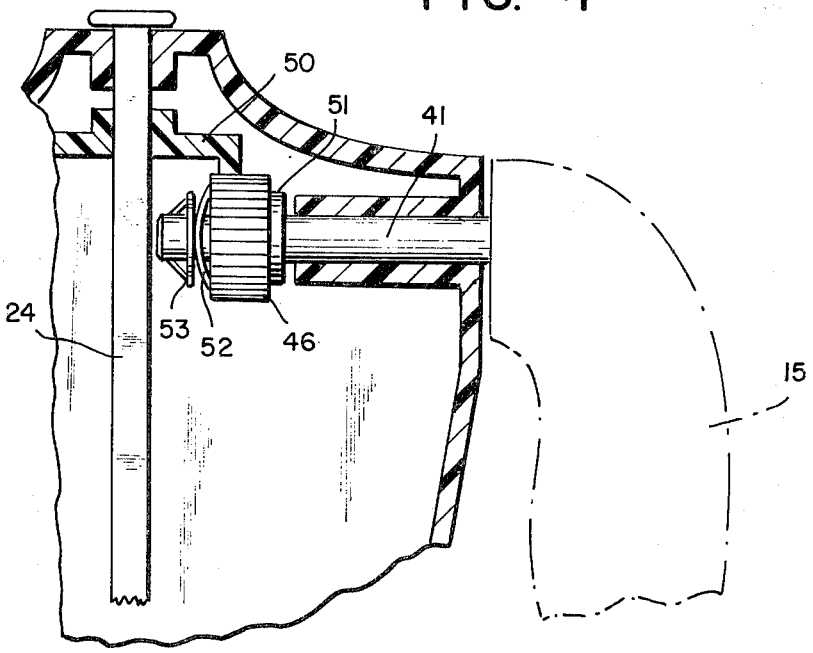
FIG. 4 is a cross-sectional view of a portion of the upper torso of a fighting doll with a slip clutch means associated with the appendage being shown in phantom lines.

The starting position of second arm 15 can be changed or adjusted by means of a slip clutch as shown in FIG. 4. The second arm pinion 46 is rotatably mounted on the shaft 41, and is positioned between a shoulder 51 and a spring washer 52. The spring washer is biased against the second arm pinion 46 by means of a push nut 53. In ordinary use, there is sufficient friction between the shoulder 51 and the arm pinion 46 to swing the arm 15 when the upper torso 13 rotates. However, should a change in the position of the second arm 15 be desired, the second arm 15 can be rotated without damaging the actuating means since the second arm pinion 46, which remains engaged with cup gear 50, can rotate on the second shaft 41. In addition, if too much resistance is exerted against the arm as it is swinging, the second arm pinion 46 can rotate on the second shaft 41 without turning the second shaft 41 once the friction between the second arm pinion 46 and the shoulder 51 is overcome. A second slip clutch can be placed on the shaft 40 to allow for similar movement of the first arm 14.

Figure 5:
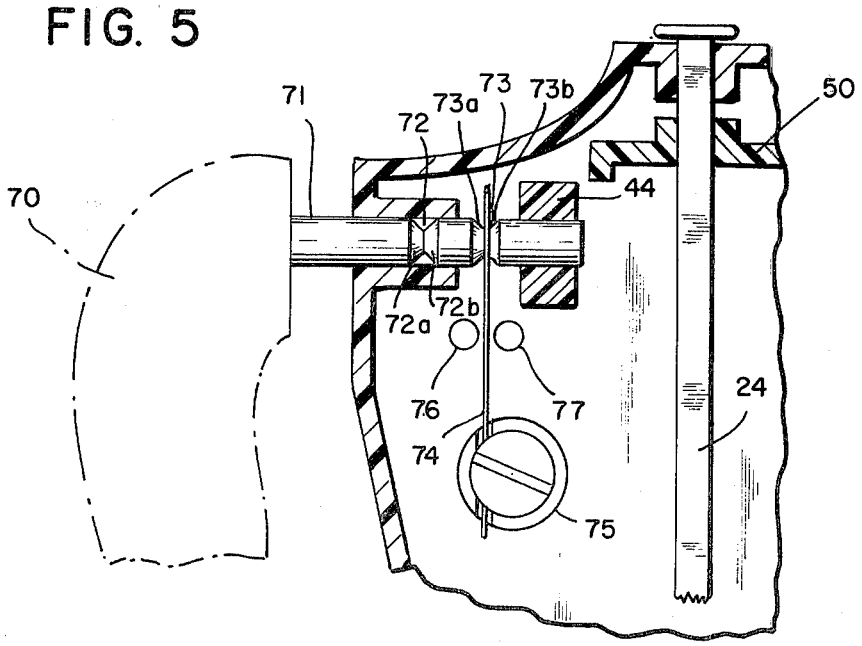
FIG. 5 is a cross-sectional view of a portion of the upper torso of a fighting doll showing the disengagement means with the appendage shown in phantom lines.

A disengagement means is depicted in FIG. 5 to permit the first arm 14 to be easily disengaged from the cup gear 50. The shaft 71 is provided with two detent grooves 72 and 73 cut into the shaft 71. A detent spring 74 is fastened to the upper torso 13 by means of a locking screw 75. When the first arm pinion 44 at the end of shaft 71 is engaged with the cup gear 50, the detent spring 74 will ride in the groove 74. The first arm 14 is disengaged from the cup gear 50 by simply pulling it away from the upper torso 13. Since the first arm pinion 44 will no longer be engaged with the cup gear 50, when the upper torso 13 pivots, only the other arm will swing, simulating a karate blow. The first arm 14 is locked in the disengaged position by detent spring 74 riding in the detent groove 73. The edges 72*a* and *b* of the detent groove 72 and the edges 73*a* and *b* of the detent groove 73 are inclined to permit an easy transition from the engaged to the disengaged position. Guide pins 76 and 77 prevent internal movement of the detent spring 74 when the position of the first arm 14 is changed.

Figure 6:
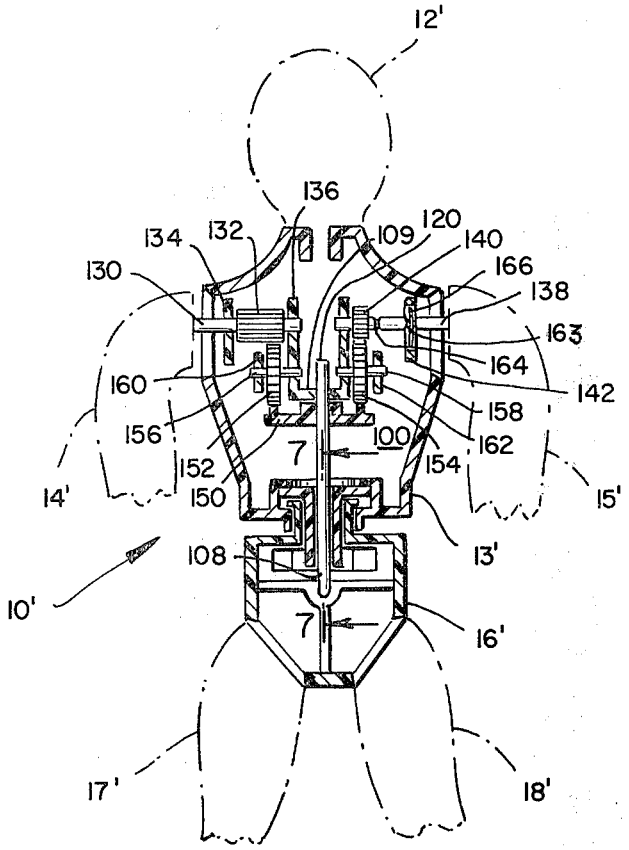
FIG. 6 is a cross-sectional view of the body of a fighting doll constructed with an alternative embodiment of the present invention wherein the appendages are shown in phantom lines.
Figure 7:
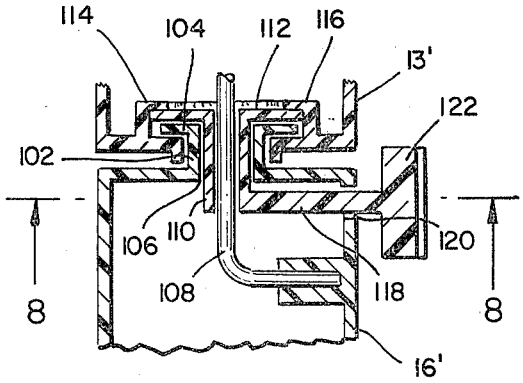
FIG. 7 is an enlarged sectional view taken substantially along the line 7—7 of FIG. 6.
Figure 8:
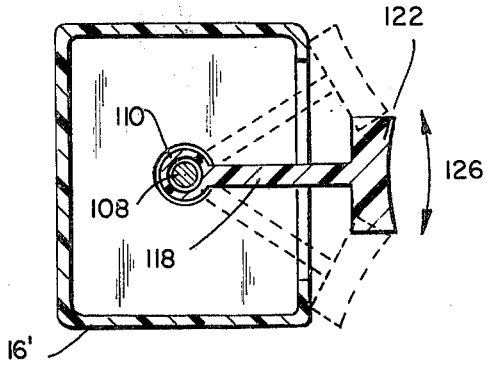
FIG. 8 is a sectional view taken substantially along the line 8—8 of FIG. 7.

An alternative embodiment of the fighting doll is illustrated in FIGS. 6–8 wherein the doll generally identified by the reference numeral 10′ has a head 12′ fixed to an upper torso 13′. First and second arms 14′ and 15′ respectively are mounted to the upper torso, so that they are free to swing. The upper torso 13′ is pivotably secured to the lower torso 16′ in a manner which will hereinafter be described. Legs 17′ and 18′ depend from the lower torso 16′ and may be integrally formed therewith.

An actuating means in accordance with the alternative embodiment is located within the body of the fighting doll 10′ and is identified generally by the reference numeral 100. The lower torso 16′ has an upwardly extending annular neck 102 terminating in a flange 104. The upper torso 13′ has an opening 106 in which the neck 102 is rotatably received. The flange 104 is sized greater than the opening 106 and acts to retain the upper torso on the lower torso. A central shaft 108 is fixedly connected to the lower torso and extends through the neck 102 into the upper torso and is journaled in the upper torso in a main support frame 109. Rotatably secured in the shaft 108 is a sleeve 110 which also extends through the neck 102 into the upper torso. Formed at one end of the sleeve 110 is an enlargement 112 which is positioned between ribs 114, 116 on the upper torso. At the opposite end of the sleeve 110 is a lever arm 118 which extends through a slit 120 in the lower torso. When the lever arm is moved in the direction of arrows 126 in FIG. 8, the sleeve 110 rotates on the shaft 108, causing the upper torso to pivot relative to the lower torso. The lever arm 118 may have integrally formed therewith a tab 122 to facilitate manipulation of the lever.

As hereinabove mentioned the first and second arms 14′ and 15′ are mounted to the upper torso 15′ in such a manner that they may rotate or swing thereon. Extending from a first arm 14′ is a first shaft 130 which has a first arm pinion 132 mounted at its end. Shaft 130 is journaled within the support 134 and the support frame 109 is free to rotate therein. Similarly, the second arm 15′ has a second shaft 138 extending from its upper end with a second arm pinion 140 mounted thereto. The shaft 138 is journaled within the support 142 and the support frame 109 and is then free to rotate therein. Fixedly secured to the shaft 108 is a cup gear 150 which is in operable communication with the arm pinions 132 and 140 through gears 152 and 154 which are mounted to shafts 156, 158 that are journaled within support 160 and support frame 109 and support 162 and support frame 109, respectively. Since the stationary cup gear 150 is fixed on the shaft 108 when the lever arm 118 is manipulated causing the upper torso 13′ to rotate, the stationary cup gear 150 will move the gears 152, 154 resulting in the arm pinions 132, 140 moving and causing the first and second arms 14′ and 15′ to swing upwardly in a fighting motion.

It will be appreciated that the starting positions of the first and second arms 14′ and 15′ can be changed or adjusted by utilizing a slip clutch mechanism identical to the mechanism described in FIG. 4.

As was hereinabove discussed with the alternative embodiment disclosed in FIGS. 1–5, one of the arms 14′, or 15′ can be easily disengaged from its associate gear 152, 154 so that only one arm will swing and the other will remain motionless. As shown in FIG. 6, the second shaft 138 may be provided with two detent grooves 160 and 164 cut into the second shaft 138. A detent spring 166 is held with the support 142. When the second arm pinion 140 is engaged with the gear 154, the detent spring 166 will lie in the groove 160 as shown. The second arm 15′ is disengaged from the gear 154 by simply pulling it away from the upper torso 13′. Since the second arm pinion 140 is no longer engaged with the gear 154, when the upper torso 13′ pivots, only the first arm 14′ will swing simulating a karate blow. The second arm 15′ is locked in the disengaged position by the detent spring 166 riding in the detent groove 164.

It will be appreciated that the disengagement means just described is a structural variation of the disengagement means described in FIG. 5 and either type of disengagement means can be used in either of the fighting doll embodiments disclosed hereinabove.

It can be seen from the foregoing detailed description the object of the present invention; namely, to create a realistic fighting doll has been achieved by providing an actuating means within the doll which when activated will cause the upper torso of the doll to pivot relative to the lower torso, and simultaneously cause the arms of the doll to swing upward and downward in a fighting motion.

In one embodiment, the actuating means is activated by a push button extending from the lower torso. The upper torso is pivotably secured to the lower torso and to a central shaft which is fixedly mounted to the lower torso. A stationary cup gear is positioned on the central shaft and is in communication with an arm pinion secured to a shaft extending from each arm. The push button has a rack formed at its end which is in communication with a pinion rotatably mounted on the central shaft.

A sleeve, which is free to rotate on the central shaft is fixed to the pinion and is secured to the upper torso. By depressing the push button, the pinion and sleeve rotate on the central shaft causing the upper torso to pivot. As the upper torso pivots, the arm pinions move on the stationary cup gear resulting in the arms moving in a fighting motion. Biasing means returns the upper torso and the arms to a rest position when the push button is released.

In another embodiment the actuating means is activated by a lever extending from the lower torso. The upper torso is rotatably secured to the lower torso. A central shaft is fixedly connected to the lower torso and supports a stationary cup gear within the upper torso which is in communication through gears with an arm pinion mounted to a shaft extending from each arm. The lever extending from the lower torso has integrally formed therewith a sleeve which is rotatably mounted on the central shaft. Formed at the end of the sleeve is a plate which is secured to the upper torso. When the lever is moved the sleeve rotates on the central shaft causing the upper torso to pivot relative to the lower torso. Simultaneously therewith the gears move on the stationary cup gear causing the arm pinions to move resulting in the arms swinging in a fighting motion.

Each of the arms may be disengaged in either of the embodiments so that only the other arm will swing in response to the actuating means. A slip clutch permits the rest position of the arms to be changed and prevent damage to the arms and the actuating means as excessive resistance to the movement of the arms is encountered.

While in accordance with the patent statutes preferred and alternative embodiments have been shown in detail, it should be particularly understood that the invention is not limited thereto or thereby.

What is claimed is:

1. A fighting doll comprising:
   a. a lower torso having legs depending therefrom;
   b. an upper torso pivotably mounted to said lower torso;
   c. a first arm rotatably mounted to said upper torso;
   d. a second arm rotatably mounted to said upper torso;
   e. a first shaft extending from said first arm at its shoulder portion to rotatably support said first arm in said upper torso;
   f. a second shaft extending from said second arm at its shoulder portion to rotatably support said second arm in said upper torso; and
   g. actuating means in communication with said first and second shafts including
      i. a central shaft within said upper and lower torsos said central shaft being fixed at one end to said lower torso;
      ii. a first means in communication with said central shaft and said upper torso; and
      iii. a second means in communication with said central shaft and said first and second shafts;
   h. said actuating means permitting said upper torso to pivot relative to said lower torso and said first and second arms to swing simultaneously with said movement of said upper torso in a fighting motion when said actuating means is activated.

2. The fighting doll in accordance with claim 1 wherein said first means comprises a sleeve rotatably mounted on said central shaft and fixed to said upper torso so that when said sleeve is rotated on said central shaft said upper torso will pivot relative to said lower torso.

3. The fighting doll in accordance with claim 2 wherein said first means further comprises a lever projecting from said lower torso integrally formed with said sleeve so that when said lever is manipulated, said sleeve will rotate on said central shaft causing said upper torso to pivot and said upper and lower arms to swing in a fighting motion.

4. The fighting doll in accordance with claim 1 wherein said upper torso is pivotably mounted to said central shaft, said first means is provided with a pinion rotatably mounted on said central shaft, and a sleeve rotatable on said second shaft and fixed to said pinion, said sleeve fixed to said upper torso so that when said pinion rotates on said central shaft said upper torso will pivot relative to said lower torso.

5. The fighting doll in accordance with claim 4 wherein said first means further comprises a push button, and a rack in communication with said push button and said pinion so that when said push button is depressed said pinion will rotate on said central shaft causing said upper torso to pivot and said first and second arms to swing in a fighting motion.

6. The fighting doll in accordance with claim 5 wherein said actuating means further comprises biasing means to return said upper torso and said first and second arms to a rest position when said push button is released.

7. The fighting doll in accordance with claim 1 wherein said second means comprises a stationary cup gear fixedly mounted to said central shaft, a first arm pinion mounted to said first shaft in communication with said stationary cup gear and a second arm pinion mounted to said second shaft in communication with said stationary cup gear so that when said upper torso is pivoted, said first and second arm pinions will move on said stationary cup gear and said first and second arms will swing in a fighting motion.

8. The fighting doll in accordance with claim 7 wherein said second means further comprises a pair of gears rotatably mounted within said upper torso, said pair of gears in operable communication with said stationary cup gear and said first and second arm pinions so that when said upper torso rotates, said gears move on said stationary cup gear so that said first and second arms will swing in a fighting motion.

9. The fighting doll in accordance with claim 7 wherein said first and second arm pinions are rotatably mounted on said first and second shafts, a first slip clutch means is mounted to said first shaft in communication with said first arm pinion, and a second slip clutch means is mounted to said second shaft in communication with said second arm pinion so that said arms may be moved or prevented from moving without interfering with said actuating means.

10. The fighting doll in accordance with claim 9 wherein said first slip clutch means comprises a first shoulder on the first shaft in frictional contact with said first arm pinion, a first push nut on said first shaft and a first spring washer on said first shaft between said first push nut and said first arm pinion biasing said first arm pinion against said first shoulder so that said first arm pinion may rotate on said arm if force against said arm is greater than said frictional contact between said shoulder and said first arm pinion without swinging said first arm and said second slip clutch means comprises a second shoulder on said second shaft in frictional contact with said second arm pinion, and a second push nut on said second shaft, a second spring washer on said second shaft between said second push nut and said second arm pinion, biasing said second arm pinion against said second shoulder so that said second arm pinion may rotate on said second arm if force against said second arm is greater than said frictional contact between said second shoulder and said second arm pinion, without swinging said second arm.

11. The fighting doll in accordance with claim 1 further comprising a disengaging means in communication with said first and second shafts so that each of said arms may be independently disengaged from said actuating means to keep said arm motionless while said other arm swings.

12. The fighting doll in accordance with claim 11 wherein said disengagement means comprises:

a. a first groove in said first shaft;

b. a second groove in said first shaft parallel to said first groove between said first groove and said first arm;

c. locking means communicating with said first and second grooves to lock said first arm in a desired position, said first groove being a distance from said first arm pinion such that when said first arm is pulled from said upper torso said locking means communicates with said first groove and said first arm pinion is not engaged with said stationary cup gear, so that said first arm will not swing when said actuating means is activated, and when said arm is pushed into said upper torso said locking means communicates with said second groove and said first arm pinion engages said stationary cup gear so that said first arm will swing when said actuating means is activated;

d. a third groove in said second shaft;

e. a fourth groove in said second shaft parallel to said third groove between said third groove and said second arm; and f. locking means communicating with said third and fourth groove to lock said second arm in a desired position, said third groove being a distance from said second arm pinion such that when said arm is pulled from said upper torso said locking means is in communication with said third groove and said second arm is not engaged with said stationary cup gear so that said first arm will not swing when said actuating means is activated, and when said second arm is pushed into said upper torso said locking means communicates with said second groove and said second arm pinion engages with said cup gear so that said second arm will swing when said actuating means is activated.

13. The fighting doll in accordance with claim 12 wherein said locking means comprises a spring.

* * * * *

UNITED STATES PATENT OFFICE
CERTIFICATE OF CORRECTION

PATENT NO. : 4003158

DATED : January 18, 1977

INVENTOR(S) : TOBIN WOLF

It is certified that error appears in the above-identified patent and that said Letters Patent are hereby corrected as shown below:

Delete the following under the caption Inventors:

Tit Shing Wong
Kowloon, Hong Kong

In the name of the Assignee, change

"Corporation" to --Corp.--.

Signed and Sealed this

Nineteenth Day of April 1977

[SEAL]

*Attest:*

RUTH C. MASON
*Attesting Officer*

C. MARSHALL DANN
*Commissioner of Patents and Trademarks*